United States Patent [19]

Brenner

[11] 4,417,457

[45] Nov. 29, 1983

[54] AGITATOR MOUNTED DISPENSER AND SHOWER SPRAY DEVICE FOR AUTOMATIC WASHER

[75] Inventor: Robert A. Brenner, St. Joseph Township, Berrien County, Mich.

[73] Assignee: Whirlpool Corporation, Benton Harbor, Mich.

[21] Appl. No.: 417,839

[22] Filed: Sep. 14, 1982

[51] Int. Cl.[3] ..... D06F 39/02

[52] U.S. Cl. ..... 68/17 A

[58] Field of Search ..... 68/17 R, 17 A

[56] References Cited

U.S. PATENT DOCUMENTS

| | | | |
|---|---|---|---|
| 381,966 | 5/1888 | Collins . | |
| 381,986 | 5/1888 | Collins . | |
| 598,011 | 1/1898 | Rylander | 68/17 R |
| 2,127,778 | 8/1938 | Lewis . | |
| 2,766,070 | 10/1956 | Park . | |
| 2,835,122 | 5/1958 | Conlee . | |
| 2,973,636 | 3/1961 | Devery et al. | 68/17 A |
| 3,068,679 | 12/1962 | Knerr et al. | 68/17 A X |
| 3,085,417 | 4/1963 | Oles . | |
| 3,145,087 | 8/1964 | Walker . | |
| 3,145,552 | 8/1964 | McMillan et al. . | |
| 3,316,741 | 5/1967 | Harlow et al. . | |
| 3,330,135 | 7/1967 | Douglas | 68/17 A X |
| 3,724,242 | 4/1973 | Davis . | |
| 3,736,773 | 6/1973 | Waugh | 68/17 A |
| 3,757,544 | 9/1973 | Olthuis . | |
| 4,240,277 | 12/1980 | Manthei | 68/17 A |

*Primary Examiner*—Philip R. Coe
*Assistant Examiner*—Frankie L. Stinson
*Attorney, Agent, or Firm*—Hill, Van Santen, Steadman & Simpson

[57] ABSTRACT

An agitator mounted wash additive dispenser and shower spray is provided for an automatic washer wherein a charge of wash additive is retained in a vertical axis agitator during an agitation step at which time it is diluted, and then is dispensed into the wash tub after the spinning step. The agitator has spray means which provide an umbrella spray of wash liquid returning from a flow passage in the agitator to the wash tub.

9 Claims, 7 Drawing Figures

FIG. 1
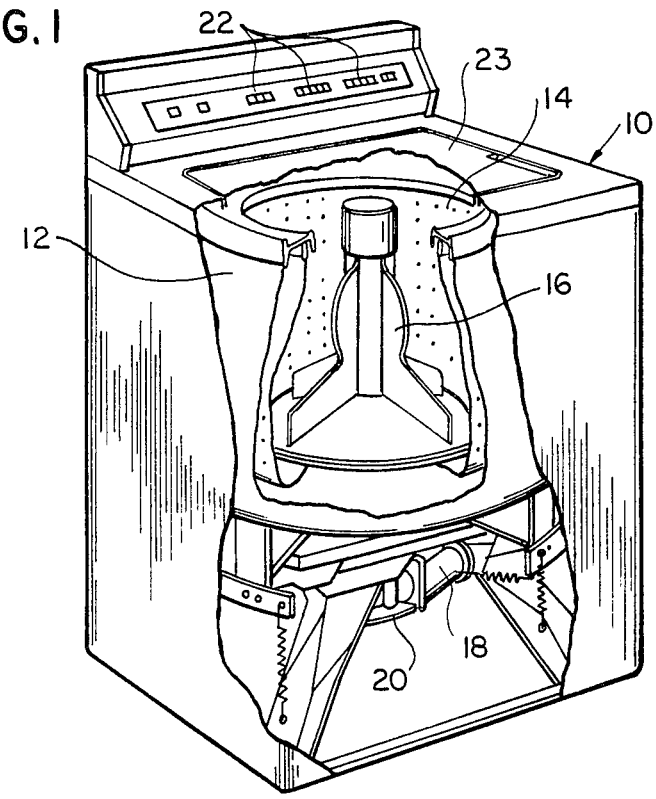
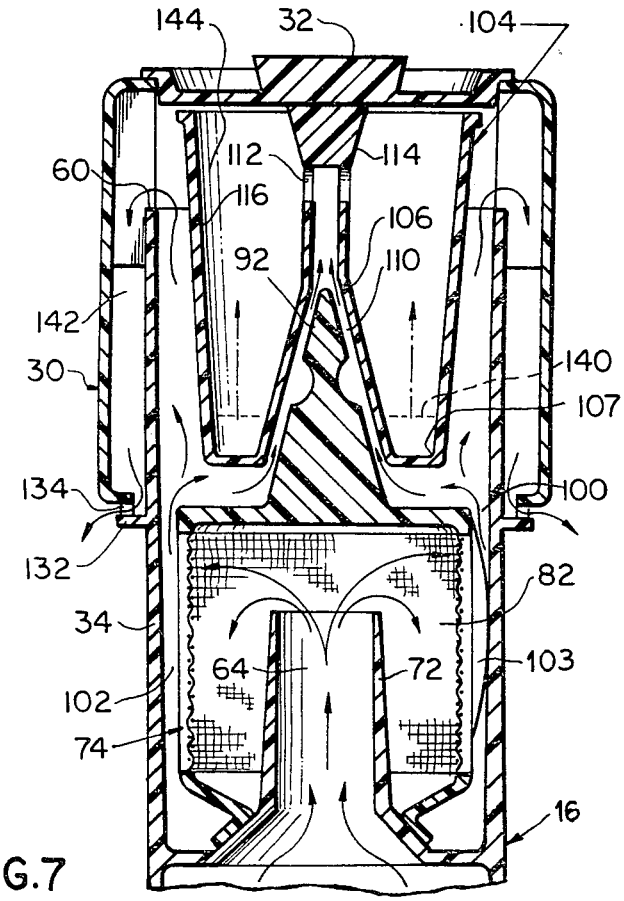
FIG. 7
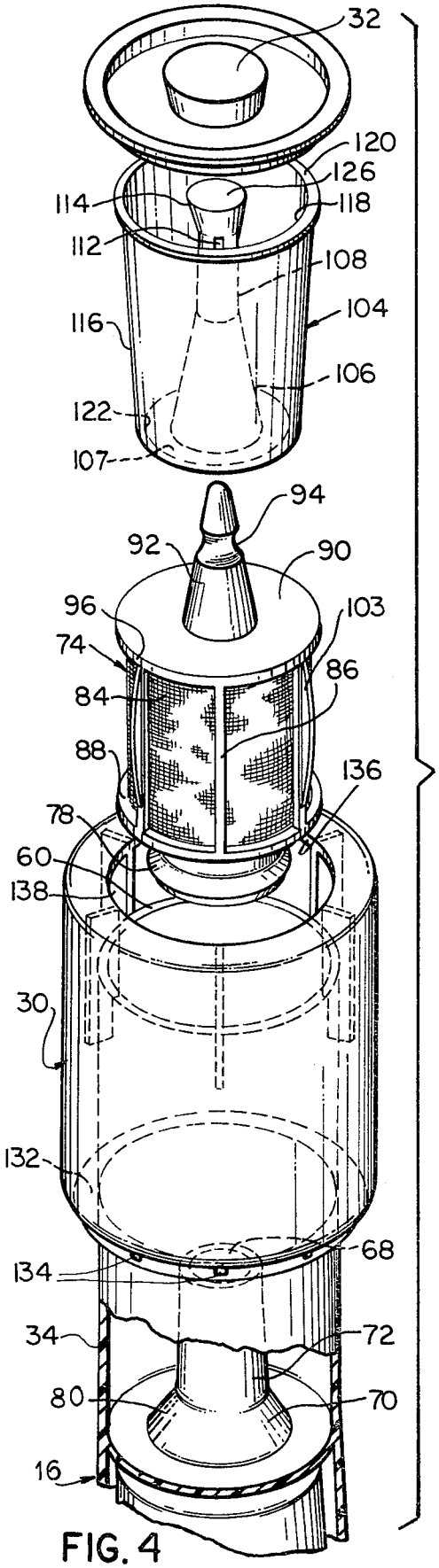
FIG. 4

FIG. 2
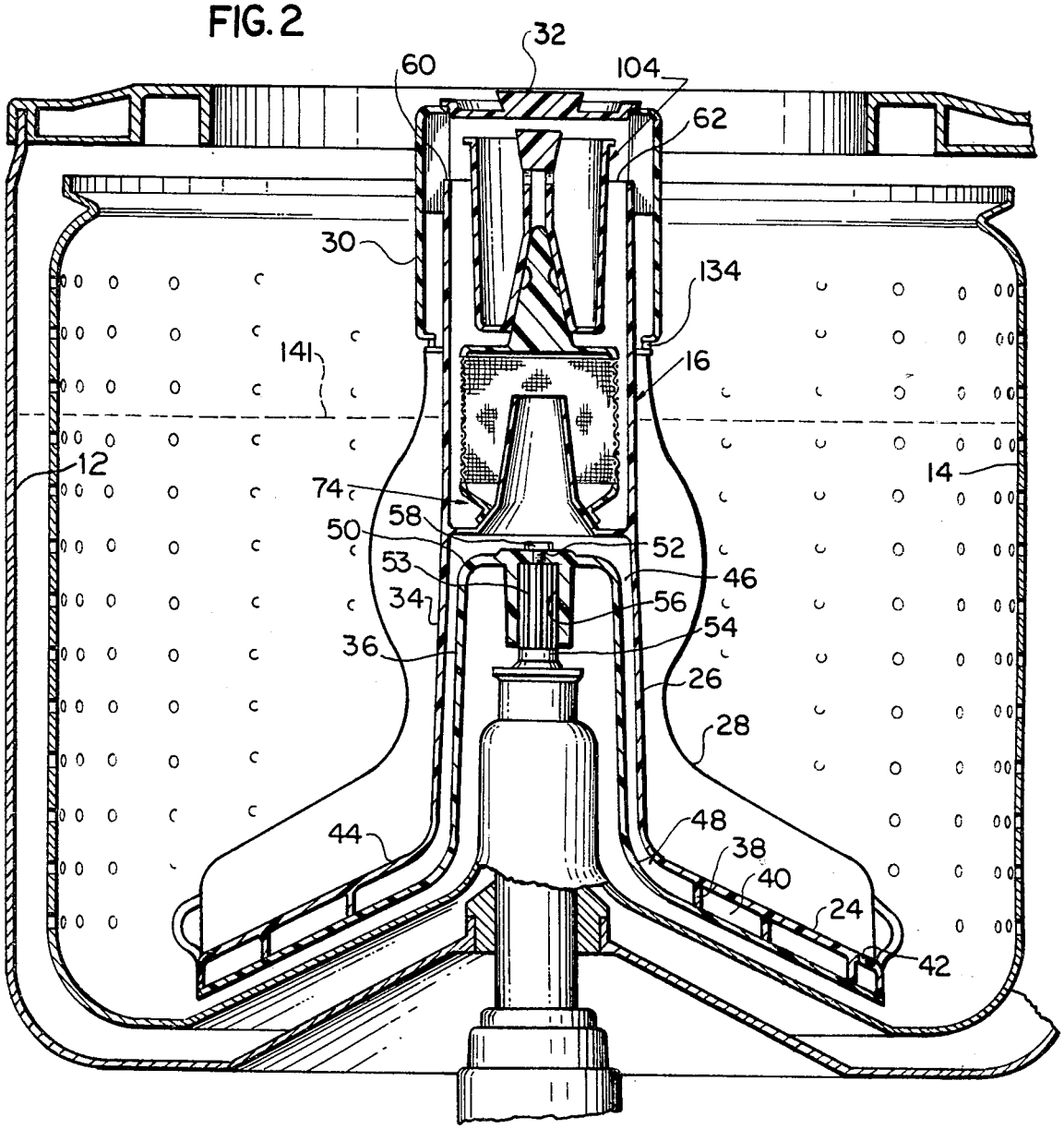
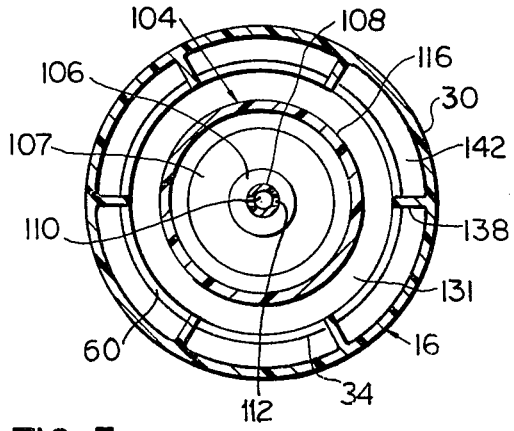
FIG. 5
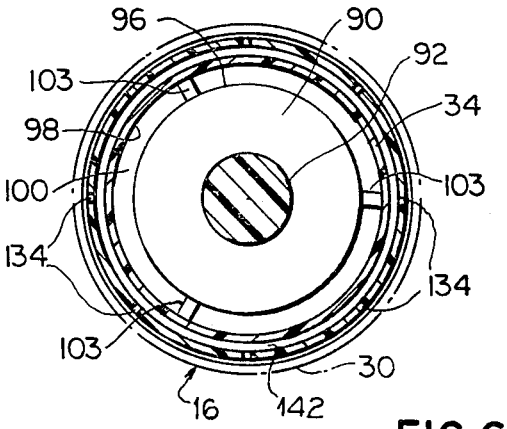
FIG. 6

AGITATOR MOUNTED DISPENSER AND SHOWER SPRAY DEVICE FOR AUTOMATIC WASHER

BACKGROUND OF THE INVENTION

1. Field of the Invention

This invention relates to a means for dispensing a wash liquid additive and more specifically to the automatic dispensing of a wash liquid additive by means of a liquid pumping agitator in an automatic clothes washer.

2. Description of the Prior Art

U.S. Pat. No. 3,145,552 discloses an agitator mounted dispenser which utilizes wash liquid pumped by the agitator to rinse out a detergent receptacle. U.S. Pat. No. 2,835,122 discloses a detergent dispenser that utilizes a float valve which rises as the liquid level within the wash tub increases to expose openings in the base portion of the dispenser to rinse out the granular detergent. U.S. Pat. No. 3,085,417 discloses an agitator mounted dispenser for wash additives including a cup for holding an additive to be diluted during an agitation step and dispensed after a spin step. U.S. Pat. No. 3,724,242 discloses a washing additive dispenser including a valve operated by the level of wash liquid in the tub or by the movement of the agitator to dispense a wash additive from a receptacle in the tub during the agitation step. U.S. Pat. No. 381,986 discloses a sprinkler system for streets which utilizes a tank and two sprinkler heads and discloses that the supply passsages to the sprinkler heads should be larger than the openings in the sprinkler heads in order to increase the area of spray from the sprinklers.

SUMMARY OF THE INVENTION

The present invention provides a means of automatically dispensing a rinse additive during a rinse cycle of an automatic washing machine which has an agitator mounted dispenser. The dispenser utilizes a floating cup actuated by wash liquid pumped up through the agitator to dilute and dispense the rinse additive. A built-up pressure head within the agitator barrel is utilized in combination with centrifugal force created by the oscillating agitator to produce an umbrella spray of wash liquid returning to the wash bath from the agitator.

DESCRIPTION OF THE DRAWINGS

FIG. 1 is a perspective view of an automatic washer with a portion cut away showing a liquid pumping agitator within a wash basket and wash tub.

FIG. 2 is a partial sectional view through the liquid pumping agitator and showing the dispensing means of the present invention.

FIG. 4 is an exploded perspective view of the elements comprising the dispensing means contained in the upper portion of the liquid pumping agitator.

FIG. 5 is a sectional view of the top portion of the rinse dispensing mechanism taken generally along the lines V—V of FIG. 3.

FIG. 6 is a top sectional view of the liquid dispensing means taken generally along the lines VI—VI of FIG. 3.

FIG. 7 is a partial sectional view of a liquid dispensing means during operation when the rinse additive receptacle is being filled.

DESCRIPTION OF THE PREFERRED EMBODIMENTS

Figure 3:
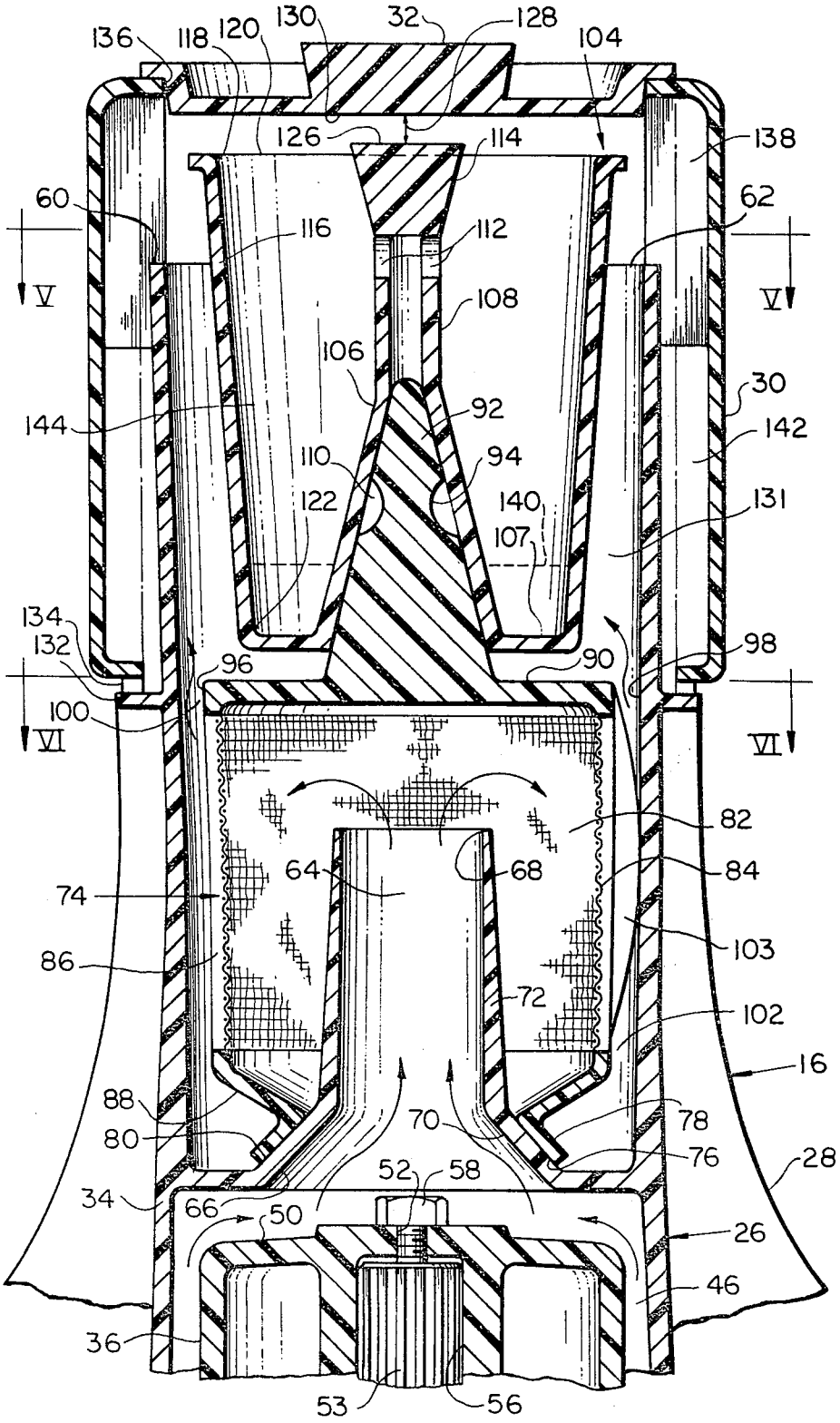
FIG. 3 is an enlarged sectional view of the top portion of the liquid pumping agitator shown in FIG. 2.

In FIG. 1 a washing machine is generally shown at 10 as having an imperforate wash tub 12 with a perforate basket 14 therein and a vertical axis liquid pumping agitator 16 also therein, a water supply (not shown) a power supply (not shown), an electrically driven motor 18 operably connected via a transmission 20 to the agitator 16 and controls 22 for use in selectively operating the washing machine 10 through a programmed sequence of agitating, rinsing and spinning steps. An openable lid 23 provides access into the open top of the basket 14.

Referring to FIG. 2, the liquid pumping agitator 16 is shown in greater detail and can be of the type disclosed in co-pending patent application Ser. Nos. 294,138 or 294,299. The agitator 16 shown is comprised of a skirt portion 24 near the bottom of the agitator and a substantially vertical barrel portion 26 integrally connected with the skirt and projecting upwardly therefrom. A plurality of vanes 28 are provided around the periphery of the barrel 26 and extend downwardly and outwardly along the skirt portion 24 of the agitator 16. At the top of the barrel 26 there is provided an enlarged cylindrical wall portion 30 with a removable lid or cover 32 at the top thereof.

The agitator 16 is of a two-wall construction having an outer wall 34 and a radially inwardly spaced inner wall 36. In a skirt portion 24 of the agitator 16 there is provided an upstanding rib 38 which extends between the inner wall 36 and the outer wall 34 and is disposed in a sprial manner as is shown in Ser. No. 294,138. The spirally disposed rib 38 thus defines an arcuate or spiral channel 40 within the skirt portion 24 of the agitator 16. A plurality of inlet apertures or openings 42 are provided through an upper wall 44 of the skirt to allow wash liquid to enter the spiral channel 40. The agitator may also have a skirt construction as shown in Ser. No. 294,299, or other type of liquid pumping agitator.

The barrel portion 26 of the agitator 16 defines an annular space or channel 46 between the inner wall 36 and outer wall 34. The annular barrel channel 46 communicates with the spiral skirt channel 40 at the base of the barrel portion shown generally at 48.

The top of the inner wall 36 terminates below the top of the outer wall 34 in a top wall 50 which has a central aperture 52 therethrough. A splined portion 53 of a drive shaft 54 mates with a cylindrical splined portion 56 of top wall 52 and is used to drive the agitator 16 in an oscillatory motion. The agitator 16 is secured to shaft 54 by means of appropriate fastening means 58 such as a bolt screwed into the splined end 53 of the shaft 54. The outer wall 34 of the agitator 16 continues upwardly beyond the top wall 50 of the inner wall 36 and terminates at a top end 60 which defines a circular opening 62.

As best seen in the enlarged view in FIG. 3, above the top wall 50 of the inner wall 36, there is provided a generally cylindrical passageway 64 disposed vertically and having an enlarged lower opening 66 and a top opening 68. The cylindrical passage 64 communicates with the annular barrel passage 46 of the agitator 16 through the enlarged opening 66. The passageway 64 is defined by a lower frusto conically shaped wall 70 which has a connecting upwardly extending cylindrical wall 72.

A filtering element 74 seen best in FIGS. 3 and 4 has a lower central opening 76 defined by a frusto conically shaped wall portion 78 which is shaped complementary to wall 70 and which rests on a top surface 80 thereof. The filter element 74 comprises an inner chamber 82, into which extends the cylindrical wall portion 72 forming passageway 64, and has a cylindrical screened wall 84 supported by a plurality of vertical ribs 86 extending between a solid bottom wall portion 88 of the filter element and a solid top wall portion 90.

Extending above the solid top wall 90 of the filter element 74 is a cone-shaped extension wall 92 having a circumferential groove 94 therein below the top thereof. This groove can be used for manually grasping the cone-shaped wall 92. The outer circumference 96 of solid top wall 90 of filter element 74 is less than the interior circumference 98 of the outer wall 34 of the agitator 16 thereby providing an annular passageway 100 from an annular chamber 102 between the filter screen body element 74 and the outer wall 34 past the upper wall 90 as seen in FIG. 6.

A plurality of spacers 103 are positioned around the circumference of filter element 74 and contact outer wall 34 to provide concentric alignment of the filter 74 within the chamber 102.

As best seen in FIGS. 3 and 4, a rinse additive dispenser cup 104 has a central conical wall 106 extending upwardly from a bottom wall 107 and which has a cylindrical wall portion 108 extending thereabove. The conical wall 106 defines a central fluid passageway 110 and a mating surface for cone wall 92. Openings 112 are provided near the top of the cylindrical wall portion 108 just below a knob shaped wall portion 114. An outer circumferential wall 116 of the dispenser cup 104 is sloped slightly outwardly such that an inner circumference 118 near a top opening 120 of the cup 104 is larger than an inner circumference 122 adjacent the bottom wall 107. A top surface 126 of the knob portion 114 is spaced a short distance 128 from a bottom surface 130 of the lid 32. The cup 104 sits within a chamber 131 in the top of the agitator 16 and the annular arrangement is best seen in FIG. 5.

The enlarged cylindrical portion 30 at the top of the agitator 16 comprises a generally cylindrical sleeve which extends from above the top end 60 of the outer wall 34 to a ledge 132 extending radially outwardly from the exterior wall 34 at a point approximately 8.9 cm (3½") below the top 60 of the exterior wall 34. A series of small openings 134 extend around the circumference of the agitator between the sleeve 30 and the ledge 132. The removable access cover 32 fits within an opening 136 in the upper edge of sleeve 30 for filling and removal of dispenser cup 104 and removal of lint filter element 74. Spacers 138 are provided to retain the sleeve 30 in concentric positions with respect to outer wall 34 by radially extending between outer wall 34 and sleeve 30 near the top of sleeve 30 as seen in FIG. 5.

In operation, the operator would put a charge of wash additive 140 (FIG. 3) into the cup 104 before the washer is started. Then, as the automatic cycle begins, the tub 12 is filled with wash liquid in the conventional manner to a maximum level 141 (FIG. 2) and the agitator is caused to oscillate thereby pumping wash liquid upwardly through the agitator as described in Ser. Nos. 294,138 and 294,299. Any means of pumping wash liquid up through the flow passage in the agitator can be used including a separate pump not associated with the agitator. The wash liquid is pumped between outer wall 34 and inner wall 36 in passageway 46 and up through passageway 64 into lint filter element 74 where it passes through the perforate wall 84 of the filter trapping lint on the inner surface of the filter. The liquid then flows into the annular chamber 102 up through passageway 100 into annular chamber 131 until it flows over the upper end 60 of the outer wall 34.

Wash liquid spilling over upper end 60 fills an annular chamber 142 between the outer wall 34 and sleeve 30 because openings 134 are sized to restrict the flow of liquid to approximately the pumping rate of the agitator at a pressure head of about 8.9 cm (3½") of wash liquid in the chamber 142 as seen by their small size in FIG. 6.

The wash liquid exiting from openings 134 is caused to move in a radially outwardly direction due to the radial positioning of the openings and due to centrifugal force of the oscillating agitator thereby producing an umbrella type spray which provides a dispersed spray on the clothes load. The pressure head developed in chamber 142 provides a sufficiently large umbrella area of spray. It is seen in FIG. 2 that the spray openings 134 are positioned above the maximum wash liquid level 141 thereby ensuring the spray feature.

When the wash liquid rises around the outside of dispenser cup 104, the dispenser will float upwardly until the top surface 126 of the knob portion 114 contacts the bottom surface 130 of the cover 32. As seen in FIG. 7 the upward movement of dispenser 104 will open passageway 110 due to the unseating of the dispenser wall 106 from cone 92. With passageway 110 open, wash liquid is free to rise therein upwardly to openings 112 and overflow into the interior 144 of the dispenser 104. As the dispenser fills with wash liquid, the additive 140 within the dispenser will mix with the wash liquid thereby diluting the additive for subsequent dispensing.

When the wash liquid has filled the interior 144 of the dispenser 104 level with the top 60 of outer wall 34, the weight of the wash liquid will cause the dispenser 104 to settle back down against cone 92 so that the passageway 110 is again sealed off. The dilute additive is dispensed from the cup 104 during the spin portion of the washing cycle following the wash agitate portion of the cycle. During spin, the agitator 16 rotates rapidly with the washer basket 14 and centrifugally propels the dilute additive out of the top of the dispenser 104 due to the dispenser's upwardly and outwardly sloped wall 116. During the spinning operation of the wash basket and agitator the dilute additive collects in an annulus along the interior surface of sleeve 30. When the agitator 16 and basket 14 come to rest at the conclusion of spinning, the dilute additive drains from the annular space 142 through openings 134 into the basket.

The washer is then refilled for a deep rinse portion of the cycle during which the lint filter 74 is operable as described above and during which the dispenser cup 104 is filled with rinse liquid in the manner described above. The shower spray through openings 134 also operates in the rinse portion of the cycle in the same manner it operated during the wash agitate portion of the cycle. At the end of the rinse portion of the cycle the agitator 16 again rotates rapidly with the washer basket 14 which centrifugally propels the rinse liquid out of the top of the dispenser thereby leaving the dispenser 104 clean and dry.

If the lint filter 74 should become plugged with lint during a washing operation the dispenser and shower spray will remain operable in that the interior cavity 82 of the lint filter 74 will become pressurized by the pumping agitator causing the filter 74 to raise off of surface 80 allowing the wash liquid to bypass the filter. The spacers 103 will assist to keep the filter 74 in vertical alignment with the cup 104.

To clean the lint filter 74, the operator would remove cover 32, grasp knob portion 114 of the additive cup 104 and lift upwardly on it to remove the cup from within the agitator, and then grasp channel 94 of cone 92 and lift upwardly to remove the lint filter. The screen wall 82 would be rinsed off and the parts returned in the opposite order to that described above. Because of the mating surfaces 76 and 80 of walls 78 and 70, and the presence of spacers 103, the filter 74 will be positively located in its precise location without alignment by the operator. Likewise, the conical wall 106 of the cup 104 mates with cone wall 92 to precisely locate the cup 104 within the agitator without alignment by the operator.

To recharge the cup 104 with additive prior to a washing cycle, the operator would only need to remove cover 32 and pour the additive into the interior 144 of the cup 104. The cover 32 would be replaced and the additive would be automatically added to the clothes load during the rinse cycle. Also, the cup 104 would be automatically cleaned prior to the end of the wash cycle.

As is apparent from the foregoing specifications, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In an automatic washer having a clothes containing basket and an upright agitator including an outer barrel adapted to pump washing liquid through a passage formed internally of the agitator, a wash additive dispenser comprising:

a cup for containing wash additive to be dispensed;

a mounting means for said cup for positioning the cup for floatation within said outer barrel;

opening means exposed by floatation of said cup for allowing wash liquid to enter said cup;

a terminal lip on said outer barrel over which liquid pumped by said agitator will overflow during a wash operation of said washer;

a sleeve, spaced outwardly of and forming an annular chamber with said outer barrel, said sleeve having upper and lower terminal portions extending toward said outer barrel;

stop means associated with said sleeve for restraining said cup during floatation in a position wherein said opening means is at a level allowing wash liquid to enter said cup when wash liquid overflows said terminal lip;

shower spray opening means defined by said sleeve and said barrel at a location spaced below said terminal lip and sized to restrict the flow of wash liquid from said shower spray openings to allow accumulation of wash liquid in said annular chamber and the creation of a liquid head at a level above said terminal lip; and means for centrifugally spinning said agitator and said cup to expel wash additive from said cup and into said annular chamber whereby the wash additive is retained in said chamber until the centrifugal spinning is terminated at which time the wash additive is allowed to drain into said basket through said shower spray opening means.

2. In an automatic washer operable through a sequence of agitating, spinning and rinsing steps, having a vertical axis agitator carried in a wash tub operable to hold a maximum level of wash liquid, an additive dispenser comprising:

a substantially vertical liquid flow passage through the interior of said agitator;

means for pumping wash liquid up through said flow passage;

spray means for returning pumped wash liquid from said flow passage to said tub;

means for establishing a pressure head of liquid within said agitator above said spray means;

means for retaining a charge of wash additive within said flow passage for dispensing;

means for diluting said wash additive during said agitating steps; and means for dispensing said dilute additive through said spray means after said spinning step, whereby said agitator provides an umbrella spray of wash liquid into said tub.

3. The device of claim 2 wherein said means for retaining a charge of wash additive comprises floatable cup means carried in said flow passage.

4. The device of claim 3 including means for filling said cup means when said cup is floating.

5. The device of claim 2 wherein said means for establishing a pressure head comprises an annular chamber positioned above said spray means for retaining a level of wash liquid, said spray means comprising openings sized to restrict liquid flow therethrough such that wash liquid is caused to accumulate in said annular chamber thereby establishing said pressure head.

6. The device of claim 2 wherein said spray means is positioned above said maximum wash liquid level.

7. The device of claim 2 including means for automatically rinsing said means for retaining an additive after said additive has been dispensed.

8. In an automatic washer operable through a sequence of agitating, spinning and rinsing steps, having a vertical axis agitator carried in a wash tub, an additive dispenser comprising:

a substantially vertical liquid flow passage through the interior of said agitator;

means for pumping wash liquid up through said flow passage;

means for returning pumped wash liquid from said flow passage to said tub;

floatable cup means carried in said flow passage for retaining a charge of wash additive to be dispensed, means for filling said cup means with wash liquid to dilute said additive when said cup is floating; and means for dispensing said diluted additive into said tub after said spinning step.

9. The device of claim 8 including means for automatically rinsing said cup means after said additive has been dispensed.

* * * * *